United States Patent [19]

Muller-Seidel et al.

[11] 4,048,751

[45] Sept. 20, 1977

[54] REMOTELY STEERED TOY BOAT

[75] Inventors: Karl-Heinz Muller-Seidel, Zirndorf; Klaus Muller-Seidel, Weiherhof, both of Germany

[73] Assignee: Firma Michael Seidel, GmbH. & Co. KG, Zirndorf, Germany

[21] Appl. No.: 675,868

[22] Filed: Apr. 12, 1976

[30] Foreign Application Priority Data

| | | |
|---|---|---|
| Apr. 18, 1975 | Germany | 2517262 |
| June 6, 1975 | Germany | 2525252 |

[51] Int. Cl.[2] ..... A63H 23/04

[52] U.S. Cl. ..... 46/250; 114/166; 115/42

[58] Field of Search ..... 46/250, 92, 93, 94; 115/12 R, 42; 114/166

[56] References Cited

U.S. PATENT DOCUMENTS

| | | | |
|---|---|---|---|
| 1,099,821 | 6/1914 | Riggin | 115/42 X |
| 2,894,477 | 7/1959 | Brown | 115/42 X |
| 3,000,128 | 9/1961 | McAda | 46/250 X |
| 3,422,787 | 1/1969 | Rush | 46/92 X |
| 3,522,788 | 8/1970 | Montague | 115/18 X |
| 3,793,769 | 2/1974 | Tong | 46/250 |

FOREIGN PATENT DOCUMENTS

| | | | |
|---|---|---|---|
| 762,747 | 1/1934 | France | 115/42 |

*Primary Examiner*—E. Barry Shay
*Attorney, Agent, or Firm*—Browdy and Neimark

[57] ABSTRACT

A drive for a remotely steerable toy boat includes a reversible motor, a propeller shaft and a propeller. A stationary deflector shield is disposed laterally of the propeller. When the propeller is driven in reverse, part of the stream of water delivered from the rear to front, relatively to the boat, is forced against the deflector. Consequently, the boat turns.

18 Claims, 4 Drawing Figures

10
1
4
9
3
II
2
15
5
8
6
19
20
12
11
7
13
II
14

18
16
17

15
2
8
22
23
24
21
13
11
14

30
31

32
37
21
22
23
24
13
33
8
11

30
35
31
36
34
32
A
37
19
18
16
17
20
8
33
6
11
13
7
4

REMOTELY STEERED TOY BOAT

FIELD OF THE INVENTION

This invention relates to drives for remotely steered toy boats having a propeller disposed below the waterline, mounted on a shaft, and adapted to be driven by a reversible motor.

BACKGROUND OF THE INVENTION

Known remotely steerable toy boats of this kind are usually controlled from a control unit either by radio or by means of electric wires connecting the control unit to the boat. They usually have the reversible drive motors, each provided with a propeller, so that maneuvering is effected similarly to the full-size prototype, that is to say changes of the direction of travel of the boat are achieved by varying the relative rotational speeds and/or reversing the direction of rotation of one or both of the two propellers.

It is also conceivable to provide only one drive motor having a single propeller and instead providing a rudder adapted to be driven by a reversible control motor.

In both cases described above two motors are required, and in addition for the purpose of remote control by radio four channels or for remote control by means of wires four wires are required, together with respective control devices in the control unit. The resulting expense is relatively great, for toy boats.

The problem underlying the invention is that of providing a drive for a remotely steerable toy boat of the kind first described above, which is maneuverable with only one propeller and one drive motor, and without the need of a remotely controlled rudder.

SUMMARY OF THE INVENTION

It is an object of the present invention to provide a drive for a remotely steered toy boat which does not require two motors.

It is another object of the present invention to provide drive for a remotely steered body which involves a single propeller and drive motor.

The foregoing objects, as well as others which are to become clear from the text below are achieved, in accordance with the present invention by providing a drive for a remotely steerable toy boat having a propeller disposed below the waterline, mounted on a shaft and adapted to be driven by a reversible motor, wherein a stationary deflector shield is disposed laterally of the propeller.

When the propeller is driven for forward travel, the deflector shield is ineffective. When, however, the propeller is driven for reverse travel, that is to say in the opposite direction of rotation, part of the stream of water delivered from rear to front (relative to the boat) is forced against this deflector shield and deflected laterally. This has the consequence that the boat turns, since a force directed transversely of the longitudinal axis of the boat acts on the deflector shield. A prerequisite is obviously that the deflector shield should not be situated exactly in the vertical neutral-torque axis extending through the center of gravity of area of the portion of the boat lying under water. This danger is however excluded because the propellers and consequently also the deflector shield are practically always situated in the stern region of the boat.

The optimum position of the deflector shield is achieved when the shield is disposed directly in front of the propeller in the direction of travel of the boat. It has been found particularly simple and expedient for the deflector shield to have the form of an annular cylinder segment disposed symmetrically to the horizontal and open on one side, its overlap angle advantageously being smaller than 240°. In order to keep flow losses as low as possible, that is to say to be able to make a turning maneuver as quickly as possible, it is advantageous for the distance between the deflector shield and the shaft to be only slightly greater than the radius of the propeller.

If, according to another advantageous preferred feature of the invention, a baffle plate disposed transversely of the direction of travel is provided near and in front of the propeller, in the direction of travel, on the one hand the deflection effect will be improved and on the other hand the boat will be prevented from traveling astern at all, so that the boat is turned and its change of direction of travel achieved without any — partial — reverse movement. It is expedient for the diameter of the baffle plate to be larger than the diameter of the propeller. It has been found particularly simple to make the baffle plate and the deflector shield in one piece.

If in accordance with another advantageous feature of the invention the baffle plate and the deflector shield are in the form of a part mounted on the shaft casing or motor casing, this part can in addition be built into practically any known boat driven by a submerged propeller.

If the motor is fastened under the boat, it is particularly advantageous for the propeller to be disposed underneath the bottom of the boat, ahead of the stern part. The bottom of the boat is then also used for deflecting toward the deflector shield part of the water moved by the propeller, and thereby intensifying the turning effect.

If on the other hand the drive is disposed behind the boat, as is particularly the case with drives in the form of outboard motors, it is particularly expedient to provide a separate plate which extends approximately horizontally and is disposed below the waterline, and which in this arrangement produces the same effect as the bottom of the boat. It is particularly advantageous for the plate to be disposed above the propeller and for the deflector shield to merge into the plate. In this arrangement a kind of channel or duct, which produces a particularly powerful turning effect, is formed by the plate and the deflector shield.

Through the measures according to the invention the particular effect is achieved that, since only one reversible motor is required for propulsion and maneuvering, only one simple change-over switch is required in the control unit with two wires leading to the boat or only a single radio control channel is needed in the case of radio control of the boat.

DETAILED DESCRIPTION OF THE PREFERRED EMBODIMENTS

Figure 1:
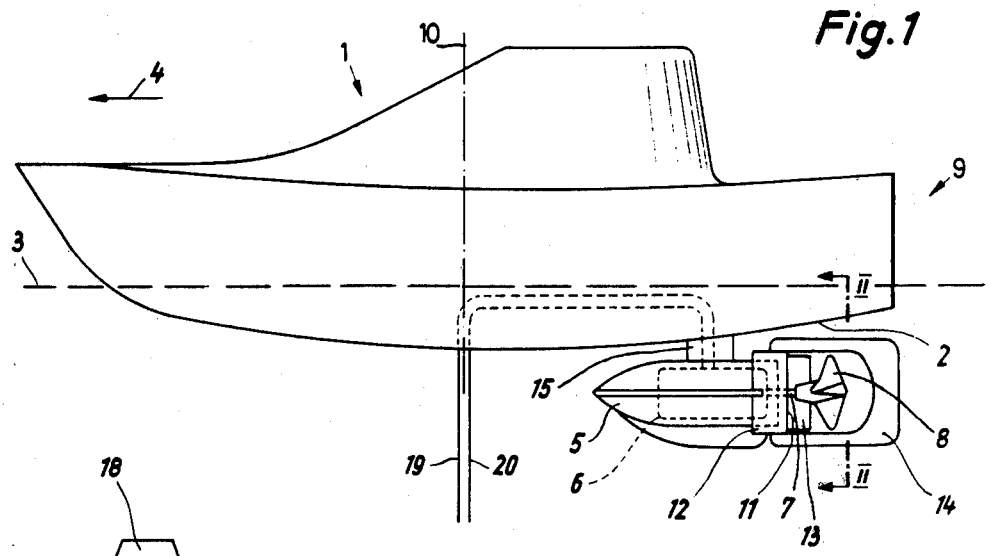
FIG. 1 is a longitudinal view of a toy boat provided with drive according to the invention.

FIG. 1 shows a toy boat 1, which basically may be of any desired shape. On the bottom 2 of the toy boat 1, that is to say below the waterline 3, is disposed a commercially obtainable reversible motor 6 contained in a torpedo-shaped casing 5 whose point faces in the direction of forward travel 4. A propeller 8 is rotationally fixed on the shaft 7, which projects to the rear (referred to the direction of travel 4), of the said motor, in particular, as can be clearly seen in FIG. 1, the propeller 8 is situated in the region of the stern 9 of the toy boat 1, that is to say definitely behind the vertical axis 10, extending through the center of gravity of area, of the boat's underwater body.

Between the propeller 8 and the casing 5, that is to say practically forming the after closure of the casing 5, is situated a circular baffle plate 11 which is disposed transversely of the shaft 7, that is to say radially, and which is fastened by means of an annular collar 12 on the rear periphery of the casing 5. The diameter of the baffle plate 11 is slightly larger than the diameter of the propeller 8.

Figure 2:
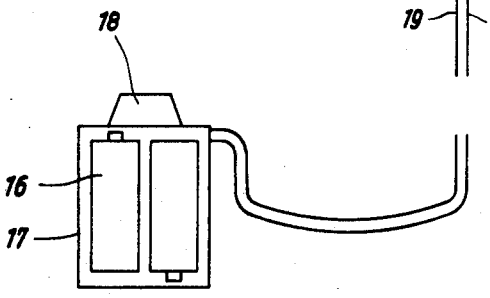
FIG. 2 is a cross-sectional view of the drive shown in FIG. 1, the section being taken along section line II—II of FIG. 1.
Figure 2:
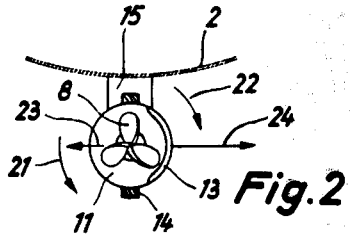

A deflector shield 13 which is in the form of an annular cylindrical segment, and which has an overlap angle of about 130°, is disposed laterally and symmetrically to the horizontal plane of the outer edge of the baffle plate 11. As can be seen in FIG. 2, the distance between the deflector shield 13 and the shaft 7 is slightly greater than the radius of the propeller 8. Its after boundary edge lies directly ahead of the propeller 8. A stabilization fin 14, which in known manner enables the boat to travel straight ahead even without a steering rudder, and which extends in the longitudinal direction of the boat 1, that is to say in the direction of travel 4, is mounted on the annular collar 12 of the baffle plate 11.

The motor 6 need not necessarily be disposed in the casing 5 and immovably connected to the boat 1 by means of a connector 15; it may also be situated in the body of the boat 1. This is less advantageous, and in this case the casing 5 serves solely as a shaft casing and the drive is transmitted from the motor to the shaft by means of suitable transmission devices.

In the embodiment illustrated, batteries 16 necessary for driving the motor 6 are disposed in a control unit 17, on which a pole reverser 18 is mounted. The connection between the pole reverser 18 and the motor 6 is made by way of two lines 19, 20, that is to say a two-core cable which passes through the bottom 2 of the boat 1 along the axis 10, in order that during the movement of the boat 1 no torque resulting in unintentional maneuvering of the boat 1 are produced.

The boat is propelled in the forward direction in the conventional manner by the turning of the propeller in the direction of the arrow 21.

If on the other hand the pole reverser 18 is operated so that the motor turns in the opposite direction, as shown by the direction of rotation arrow 22, part of the stream of water delivered from rear to front (relative to the boat 1) is forced against the deflector shield 13 and is deflected laterally to the left (in FIG. 2) in the direction of the arrow 23, that is to say an oppositely directed reaction force acts on the deflector shield 13 as indicated by the arrow 24, which force turns the boat about the axis 10. The baffle plate 11 prevents the boat from moving backwards at all, since the part of the stream of water delivered from rear to front (relative to the boat 1) and not thrown against the deflector shield 13 merely produces turbulence and thus applies no reverse propulsion to the boat 1. The boat therefore turns on the spot. On completion of the maneuvers, the pole reverser 18 is operated again so that the boat travels ahead once again in the new direction. If the switch-over to maneuver and switching back to forward travel are carried out sufficiently quickly, the boat need not lose its forward travel during the maneuver.

If, as shown in the drawing, the propeller is disposed in the region of the stern 9 under the bottom of the boat 2, that is to say under and not behind the boat, it is expedient for the deflector shield 13 to be disposed on that side of the propeller 8 on which the periphery of the propeller moves downward in the direction of rotation 22 oppositely to the direction of rotation 21 for forward travel. In the customary example, which is illustrated in the drawing, where the propeller 8 turns counterclockwise for forward travel, viewed in the direction of travel 4, that is to say the propeller turns in the clockwise direction for maneuvering, in the opposite direction of rotation 22, the effect achieved by the invention is considerably intensified if, once again viewed in the direction of travel 4, the deflector shield 13 is disposed on the right or starboard side of the propeller 8. If the directions of rotation were reversed, the deflector shield 13 should then be disposed on the left or port side. This intensification of the effect is due to the fact that the bottom 2 of the boat diverts to the deflector shield a further part of the water moved by the propeller 8 when rotating in the direction 22, thereby intensifying the turning effect. In the case illustrated in the drawing the boat is therefore turned in the counterclockwise direction that is to port, viewed from above.

The baffle plate 11, the stabilizing fin 14, the deflector shield 13, and the casing 5 of the motor 6 may obviously also be made in one piece.

The length of the control lines 19, 20 between the toy boat 1 and the control unit 17 held in the hand of the operator may usually amount to from 15 to 20 meters.

Figure 4:
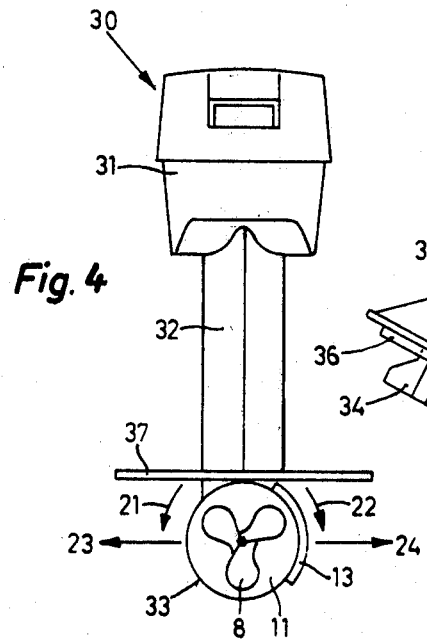
FIG. 4 is a rear view of the drive of FIG. 3 looking in the direction of the arrow A in FIG. 3.
Figure 3:
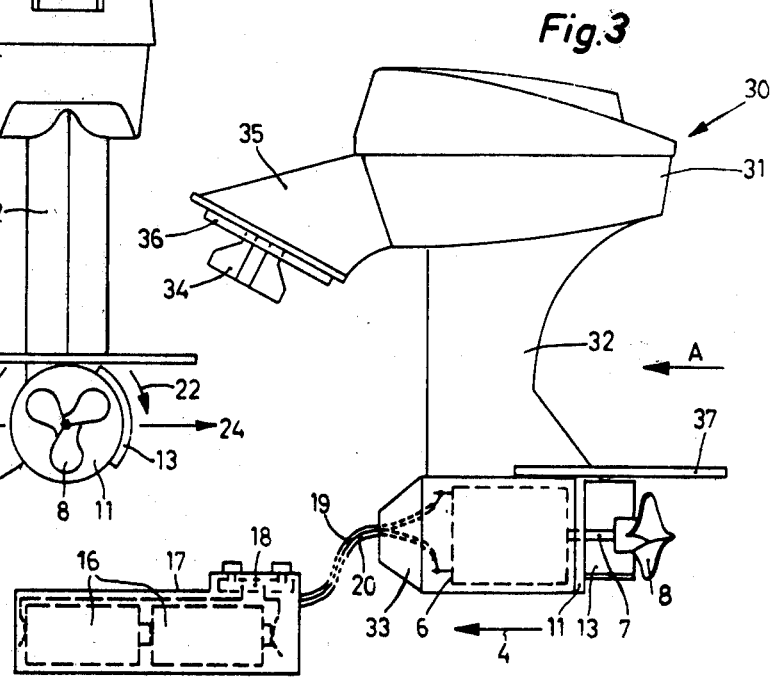
FIG. 3 is a side view of a second embodiment of a drive according to the invention, which is in the form of an outboard motor, together with a diagrammatically illustrated control unit.

In connection with the embodiment illustrated in FIGS. 3 and 4, the ensuing description is limited to the differences in comparison with the embodiment of FIGS. 1 and 2, common reference numerals being used for identical parts. FIGS. 3 and 4 show a drive 30 which is made in the form of an outboard motor, its upper portion 31, which in the full-size prototype contains the motor, is connected by way of a web 32 to the lower part 33. For the connection of this outboard motor 30 to an associated toy boat, use is made in known manner of a fastening pin 34 which is disposed on an extension 35 of the upper part 31. For the purpose of sealing and elastically clamping the outboard motor 30 on the appertaining toy boat, it is expedient for an elastic sealing washer 36 also to be provided on the fastening pin 34. The lower part 33, which tapers in the direction of travel, serves as casing for the motor 6.

The motor 6 need not necessarily be disposed in the lower part 33 of the outboard motor 30; it may also be contained in the upper part 31, although this is less advantageous, and in this case the lower part 33 serves only as a shaft casing, while transmission from the motor to the shaft is effected by means of suitable transmission means.

The lines 19, 20 are taken into the forward end of lower part 33, and then to the motor 6. Consequently, during the movement of the boat no torque resulting in unintentional maneuvering of the boat can be applied to the latter.

Above the approximately cylindrical lower part 33, that is to say at the lower end of the web 32, is disposed a horizontal plate 37 which extends rearward beyond the propeller 8 and which the top edge of the deflector shield 13 directly adjoins. This plate 37 can obviously also be formed by continuing the deflector shield horizontally and generally corresponding to the direction of the plate that is to say to the left in FIG. 4.

Forward travel and turning are effected similarly to the embodiment shown in FIGS. 1 and 2. In this embodiment the whole outboard motor unit is turned, thus leading to the turning of the boat.

In conjunction with the deflector shield 13 the plate 37 forces a channel or duct which is open at one side but bounded at the top and through which a further part of the water moved by the propeller 8 when it turns in the direction 22 is deflected to the deflector shield 13, whereby the turning effect is intensified. The plate 37 therefore fulfills a function served by the bottom 2 of the boat 1 in the embodiment shown in FIGS. 1 and 2.

Instead of remote control by means of lines, remote ratio control can also be provided, in which case only two channels are necessary for the selective control of the two directions of rotation of the motor 6.

It will be obvious to those skilled in the art that various changes may be made without departing from the scope of the invention and the invention is not to be considered limited to what is described in the specification.

What is claimed is:

1. A drive for a remotely steerable toy boat comprising:

a reversible motor;

a propeller shaft;

a propeller disposed below the waterline, mounted on said shaft and adapted to be driven by said reversible motor; and means on said boat for causing turbulent water to exert an unbalanced laterally-directed force on said boat when said motor rotates in the reverse direction, whereby said boat may be turned, said means including a stationary deflector shield disposed below said waterline and laterally of the propeller.

2. A drive according to claim 1, wherein said deflector shield is disposed directly ahead of said propeller in the direction of forward travel of the boat.

3. A drive according to claim 1, wherein said deflector shield is in the form of a segment of an annular cylinder disposed symmetrically to a horizontal plane through the propeller axis and open to one side.

4. A drive according to claim 3, wherein said segment has an overlap angle of less than 240°.

5. A drive according to claim 4, wherein said segment has an overlap angle of less than 180°.

6. A drive according to claim 1, wherein the distance between said deflector plate and said propeller shaft is only slightly greater than the radius of said propeller.

7. A drive according to claim 1, wherein a baffle plate disposed transversely with respect to the direction of travel is provided ahead of said propeller in the direction of forward travel.

8. A drive according to claim 7, wherein the diameter of said baffle plate is greater than the diameter of said propeller.

9. A drive according to claim 7, wherein said baffle plate and said deflector shield are made in one piece.

10. A drive according to claim 7, wherein said baffle and said deflector shield are in the form of a part mounted on a casing of said motor.

11. A drive according to claim 7, wherein said baffle plate and said deflector shield are in the form of a part mounted on a casing of said propeller shaft.

12. A drive according to claim 7, including a stabilizer fin, and wherein said baffle plate, said deflector shield, said stabilizer fin, and a casing of said motor are made in one piece.

13. A drive according to claim 7, wherein said baffle plate, said deflector shield and a casing of said shaft are made in one piece.

14. A drive according to claim 1, wherein said deflector shield is disposed on that side of said propeller on which the periphery of said propeller moves downward with respect to the waterline when rotating in the astern direction.

15. A drive according to claim 1, wherein said propeller is disposed under the bottom of the boat and ahead of its stern.

16. A drive according to claim 1, wherein a plate is provided extending generally horizonally and disposed below the waterline of the boat.

17. A drive according to claim 16, wherein said plate is disposed above said propeller.

18. A drive according to claim 16, wherein said deflector shield merges into said plate.

* * * * *

UNITED STATES PATENT AND TRADEMARK OFFICE

CERTIFICATE OF CORRECTION

PATENT NO. : 4,048,751

DATED : September 20, 1977

INVENTOR(S) : Karl-Heinz Müller-Seidel

It is certified that error appears in the above-identified patent and that said Letters Patent are hereby corrected as shown below:

Title page, line 2, "Muller-Seidel" should read --Müller-Seidel--

Title page, [75] the names of the inventors should read

--Karl-Heinz Müller-Seidel-- and

--Klaus Müller-Seidel--

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*